US006253595B1

(12) United States Patent
Lewis, Jr.

(10) Patent No.: US 6,253,595 B1
(45) Date of Patent: Jul. 3, 2001

(54) AUTOMATED PIPE BENDING MACHINE

(75) Inventor: Donald E. Lewis, Jr., Owasso, OK (US)

(73) Assignee: CRC-Evans Pipeline International, Inc., Houston, TX (US)

( * ) Notice: Subject to any disclaimer, the term of this patent is extended or adjusted under 35 U.S.C. 154(b) by 0 days.

(21) Appl. No.: 09/400,560

(22) Filed: Sep. 21, 1999

(51) Int. Cl.[7] ..... B21D 9/00
(52) U.S. Cl. ..... 72/369; 72/31.05; 72/702
(58) Field of Search ..... 72/16.2, 16.3, 72/17.3, 18.1, 18.2, 31.04, 31.05, 369, 702

(56) References Cited

U.S. PATENT DOCUMENTS 4,080,814 * 3/1978 Eaton ..... 72/31.04
4,649,726 3/1987 Trammell et al. ..... 72/34
5,092,150 3/1992 Cunningham ..... 72/369
5,259,224 * 11/1993 Schwarze ..... 72/369
5,275,031 * 1/1994 Whiteside et al. ..... 72/31.05
5,305,223 * 4/1994 Saegusa ..... 72/31.05
5,481,891 * 1/1996 Sabine ..... 72/369
5,651,638 7/1997 Heggerud ..... 405/154
5,682,781 * 11/1997 Schwarze ..... 72/369
5,697,240 * 12/1997 Parker ..... 72/31.05

OTHER PUBLICATIONS

Celesco Transducer Products, Inc., "Cable–Extension Position Transducer, PT8510" 1 sheet, dated Aug. 7, 1998.

* cited by examiner

*Primary Examiner*—Ed Tolan
(74) *Attorney, Agent, or Firm*—Sidley & Austin

(57) ABSTRACT

A pipe bending system employing a feedback and control system that provides continuous data to a programmed processor. The processor is programmed to automatically carry out an incremental bending cycle in which the pipe is clamped by a predefined pressure by the pin-up shoe, a stiffback is moved upwardly to a predefined position to achieve a desired angular bend in the pipe, the stiffback is returned to its fill back position, as is the pin-up shoe, whereupon the pipe is axially moved a predefined distance to proceed with the subsequent incremental bend.

20 Claims, 6 Drawing Sheets

AUTOMATED PIPE BENDING MACHINE

TECHNICAL FIELD OF THE INVENTION

The present invention relates in general to pipe bending apparatus, and more particularly to equipment for forming bends in large-diameter pipes such as the type utilized with pipelines carrying petrochemicals, and the like.

BACKGROUND OF THE INVENTION

There exists a network of pipelines throughout much of the United States for carrying both liquid and gaseous types of fuel. The pipelines generally constitute large 40–foot, 22–36 inch diameter sections that are welded together and buried underground. Of course, the pipelines follow the general contour of the earth. The path of the pipeline can also be detoured or otherwise routed around obstacles.

A major challenge to the pipeline industry is to join the ends of the individual pipes with a high-quality weld to ensure the strength integrity of the joined pipes, as well as to prevent voids or weak spots in the joint that could thereafter leak. Thus, rather than forming welded joints in the pipes to form angles, the pipes themselves are bent so as to follow the contour of the earth and circumvent any obstacle in the path of the pipeline. By bending the pipes instead of forming joints welded at an angle, the number of welds are minimized and the reliability of the pipelines is enhanced.

Because of the size of the pipes being bent, the pipe bending equipment is generally massive in nature and operated hydraulically. The movement of the pipe into the pipe bending equipment, as well as the apparatus for gripping the pipe and forming a bend therein, is all hydraulically operated under the control of an operator. Such pipe bending machines and corresponding apparatus are disclosed in U.S. Pat. No. 5,092,150 by Cunningham; U.S. Pat. Nos. 3,834,210 and 3,851,519, the disclosures of which are incorporated herein by reference. As is customary with large diameter pipes, a bend in each pipe is accomplished by making numerous small bends, each spaced from each other. With such pipe bending systems, the operator is in full control of the number of incremental bends to be made, the spacing between the incremental bends, as well as the extent of each incremental bend in the pipe. Experienced operators can efficiently control the pipe bending systems to form accurate bends in the pipes and minimize damaged or over bent pipes which result in a waste of time and the pipes themselves. When a baseline of pipe bending information is obtained by the operator, based on the particular type of pipe being operated upon, the operator can manipulate the manual controls in an attempt to repeat a number of incremental bends so that each bend is identical. While the repeatability of the formation of a number of bends is possible to a certain extent, errors and differences often occur due to the skill of the operator, fatigue, environmental conditions, etc.

It can be seen from the foregoing that a need exists for an automated pipe bending system that is controlled by a programmed processor to form incremental bends with a high degree of repeatability and accuracy. A further need exists for a programmed processor and associated equipment that is easily retrofit to an existing system to thereby automate the operation thereof Another need exists for a low-cost programmed system that enhances the repeatability and quality of pipe bends.

SUMMARY OF THE INVENTION

In accordance with the principles and concepts of the invention, there is disclosed pipeline bending apparatus and a method of operation thereof, which overcome the disadvantages and shortcomings of the corresponding prior art systems. In accordance with the preferred embodiment of the invention, a pipe bending system is disclosed, which is controlled by a programmed processor so that the quality and repeatability of the bends in a pipe are facilitated.

According to one form of the invention, a pin-up hydraulic cylinder and a stiffback hydraulic cylinder are controlled by a programmed processor. A sensor which senses the extent of the bend in the pipe provides information to the programmed processor. Other data stored in the memory of the processor includes the angle of each bend, including the amount of springback, the number of bends to be formed in the pipe, and the distance between each incremental bend. Hence, when the operator initiates a bend cycle, the processor automatically activates the stiffback hydraulic cylinder to move and thus position the pipe in a level position. The pin-up hydraulic cylinder is activated to clamp one end of the pipe into position. Next, the processor again activates the stiffback hydraulic cylinder to move and thus bend the pipe to a predefined angle, as measured by the angle sensing sensors. When the appropriate angle is reached, the processor allows the hydraulic pressure in the stiffback cylinder to be released, thus lowering the stiffback to its full down position. Also, the pin-up clamp is moved so as to release its grip on the pipe. Next, the processor controls drive rollers to grip the pipe and move it axially a certain distance in the pipe bending system, as measured by an encoder which transmits digital signals to the processor. When moved a predefined distance, the drive rollers are stopped, whereupon the processor commences to control the apparatus to form another incremental bend in the pipe. The number of incremental bends formed in the pipe are preprogrammed and thus the processor proceeds through each incremental bending operation until completed.

Because of the utilization of various sensors and feedback data, the programmed processor can control the pipe bending system so as to form highly accurate bends on a repeatable basis.

BRIEF DESCRIPTIONS OF THE DRAWINGS

Further features and advantages will become more apparent from the following and more particular description of the preferred embodiment of the invention, as illustrated in the accompanying drawings, in which like reference characters generally refer to the same parts throughout the views, and in which:

FIG. 1*a* is a side view of a pipe bending system that can be adapted for automatically bending sections of pipe;

FIG. 1*b* is a side view of the pipe bending apparatus of FIG. 1*a,* showing the operation of placing a bend in the pipe;

Figure 4:
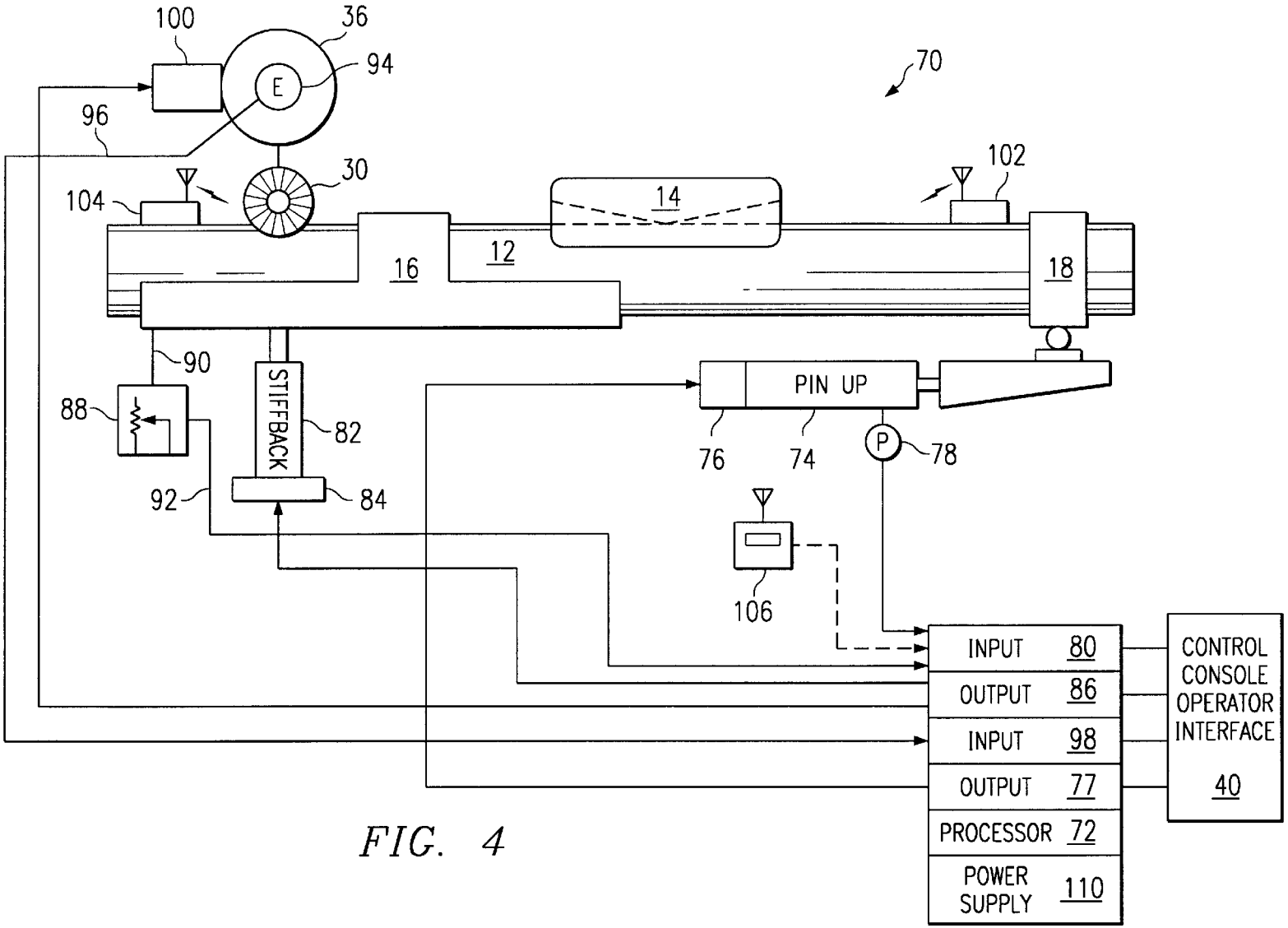
Figure 5:
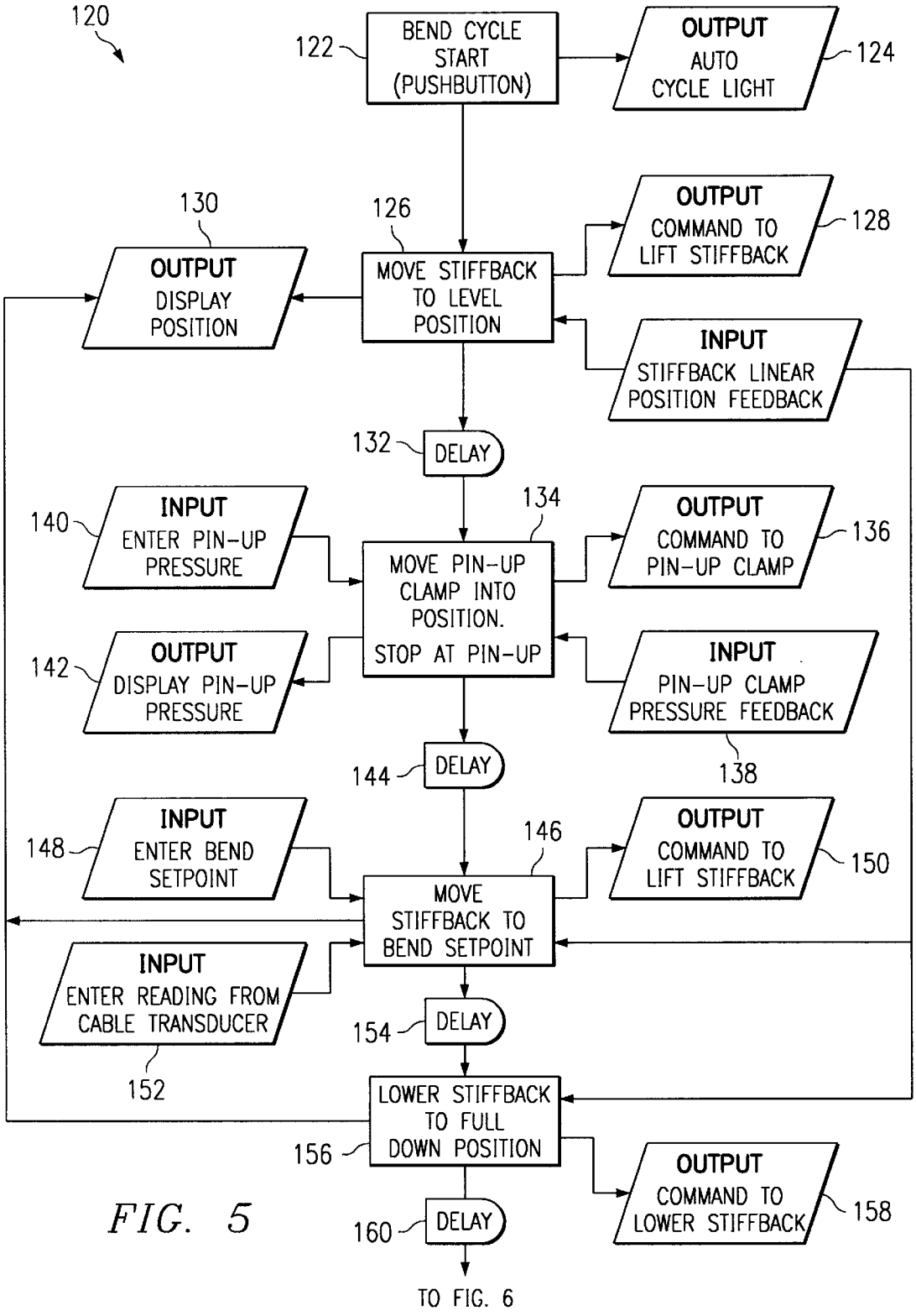
Figure 6:
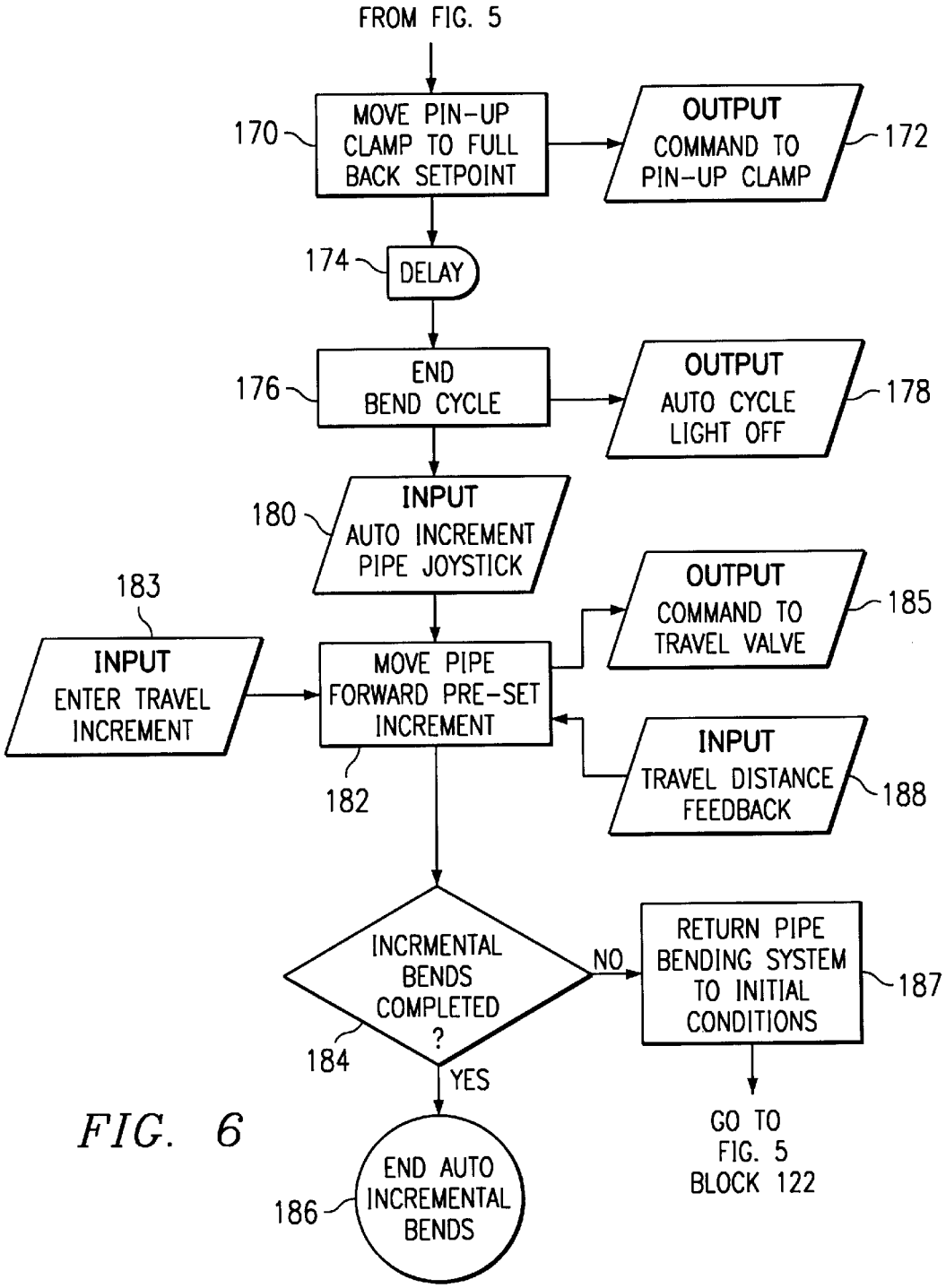

FIG. 4 diagrammatically shows the various sensors and equipment forming a control system that is operated by the programmed processor; and FIGS. 5 and 6 constitute a flow chart depicting the programmed operations of the processor.

DETAILED DESCRIPTION OF THE INVENTION

Figure 1A:
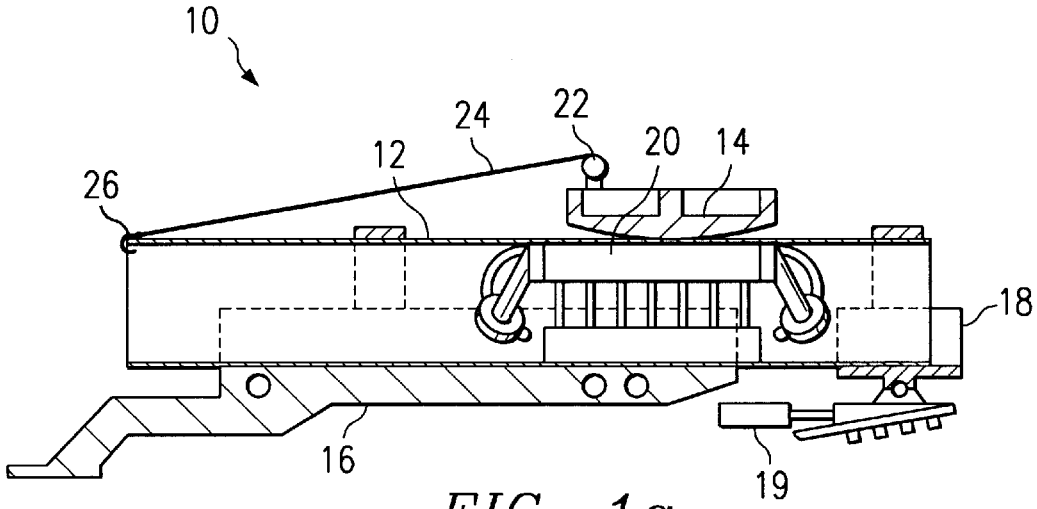
FIG. 1a (PRIOR ART)

FIG. 1*a* illustrates a conventional pipe bender 10 adapted for forming bends in large diameter pipe, such as pipes 12 preferably having diameters between 22–36 inches, as well as other pipe diameters. The pipe bender 10 can accommodate pipes 12 of standard length, which in the industry is about 40 feet. Longer pipes can, of course, be operated upon by the pipe bender 10. In general, the pipe bending system 10 includes a heavy duty frame to which the many components are anchored against relative movement. The frame of the pipe bender 10 has wheeled tracks for transportability.

The primary components of the pipe bender 10 include a bending die 14 having a bottom curved and concave surface against which the pipe 12 is forced during the bending operation. The bending die 14 is stationary with respect to the frame. As can be seen in FIG. 1*a,* the bending die 14 is engaged with the top surface of the pipe 12. While not shown, the pipe 12 is supported on its bottom surface (under the bending die) by a four-section segmented die. The segmented die is hydraulically operated to urge the pipe 12 upwardly against the bending die 14 so that the pipe does not deform at the bend during the bending operation. The segmented die is hydraulically operated by the same controls that cause the pin-up shoe 18 to be operated.

A stiffback 16 cradles the pipe 12, and is movable about a horizontal axis to move one end of the pipe 12 upwardly so as to bend the pipe around the bending die 14. Other apparatus hydraulically clamps the pipe at the stifiback end of the pipe 12. The bending die 14 and the stiffback 16 operate in conjunction with an internal pipe bending mandrel 20. The mandrel 20 is a rigid, but an articulated structure which allows the pipe 12 to be bent without crushing or otherwise internally deforming the circular nature of the pipe at the bend. Internal mandrels 20 are well known in the art.

As noted above, the stiffback 16 is operated by a hydraulic pressure to force one end of the pipe 12 upwardly, while the remainder of the pipe 12 remains in a fixed position. The remainder of the pipe 12 is fixed by the utilization of a pin-up shoe 18. The pin-up shoe 18 encircles the pipe 12 and is hydraulically operated by a cylinder 19 to be initially moved together to clamp the pipe in the fixed position, and subsequently to be released so that the pipe 12 can be moved axially to establish another location for forming an incremental bend in the pipe 12.

Figure 1B:
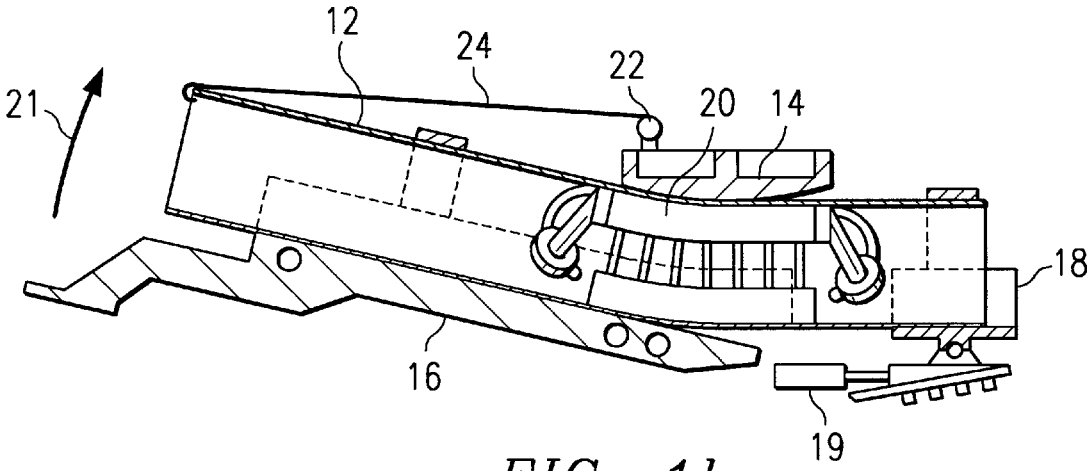
FIG. 1b (PRIOR ART)

FIG. 1*b* illustrates the stiffback 16 being pivoted in the direction of arrow 21 to form a bend in the pipe 12 around the curved surface in the bending die 14. Each pipe is generally individually bent at a specific location in the pipe, with a specific angle. Each bend placed in the pipe 12 by the pipe bender 10 is limited to a certain number of degrees to avoid damage to the pipe 12. Pipe benders can generally form bends of one degree or less during a single bending operation. Thus, if a greater curvature is required in a specific pipe 12 than is possible with a single bending operation, the pipe 12 must undergo a number of incremental bending operations, spaced apart from each other a specified distance. Hence, if a pipe were to be bent at a total of five degrees, then the pipe would undergo five incremental bending operations, each which is effective to bend the pipe one degree. This example does not consider springback which may be characteristic of a pipe. This aspect of a bending operation will be discussed below.

A winch 22 and cable can be utilized in certain instances to move the pipe 12. The end of the cable 24 is equipped with a hook 26 which, when engaged with the edge of the pipe 12, is effective to move the pipe 12 axially.

Figure 2:
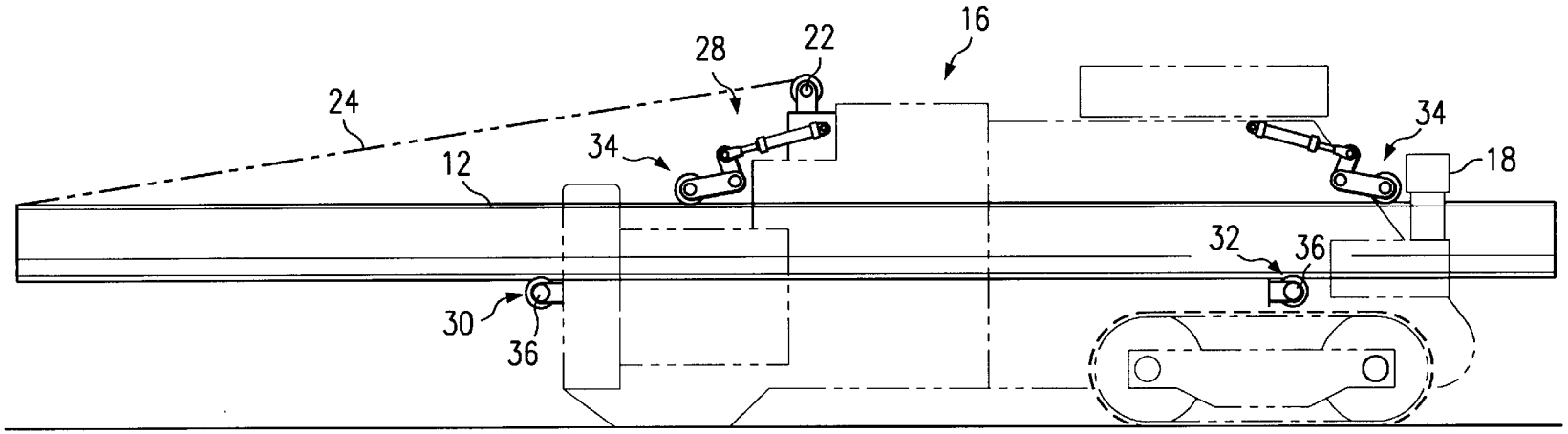
FIG. 2 (PRIOR ART)
FIG. 2 is a diagram of the pipe bending system showing powered rollers for moving the pipe within the pipe bending system.

As noted above, the pipe 12 is moved axially a specific distance between each incremental bend. FIG. 2 illustrates apparatus for axially moving the pipe 12 with regard to the pipe bender 10 shown in FIGS. 1*a* and 1*b*. The apparatus shown in FIG. 2 is described in detail in U.S. Pat. No. 5,092,150, by Cunningham. The pipe 12 is moved axially by one or more sets of power rollers which engage with the pipe 12 for movement thereof The pipe transport mechanism 28 includes a first powered roller 30 mounted to the pipe bender 10 at the front of the stiffback 16. The roller 30 is rotated by a reversible hydraulic motor 36. The motor 36 allows the roller 30 to be rotated in either direction using the hydraulic power source of the pipe bender 10. A second powered roller 32 is mounted on the pipe bender 10 between the stiffback 16 and the pin-up shoe 18. A reversible hydraulic motor 36 is also associated with the second powered roller 32. Preferably, both hydraulic motors 36 coupled to the respective rollers 30 and 32 are coupled to the same control system so that the rollers will rotate in the same direction and at the same speed.

A hold-down roller 34 includes a cross shaft 28 which is pivoted across the width of the pipe bender 10, preferably near the winch 22. Each hold-down roller 34 can be pivoted under a double-acting hydraulic cylinder to clamp the roller to the pipe 12, and to release the roller therefrom. The cooperation between the hold-down roller 34 and the powered roller 30 provides a position engagement without slippage with the pipe 12 for accurate axially movement thereof In accordance with an important feature of the invention, an encoder (not shown in FIG. 2) is mounted to at least one of the hydraulic motors of the powered rollers 30 or 32 (or both) to provide an electrical signal corresponding to the linear distance that the pipe 12 has moved. The encoder can alternatively be mounted to any of the follower rollers which contact the pipe 12. In this manner, the distance between each incremental bend in the pipe can be accurately controlled by a programmed processor, rather than relying on marks made on the pipe 12 and by the judgment of operating personnel.

Figure 3:
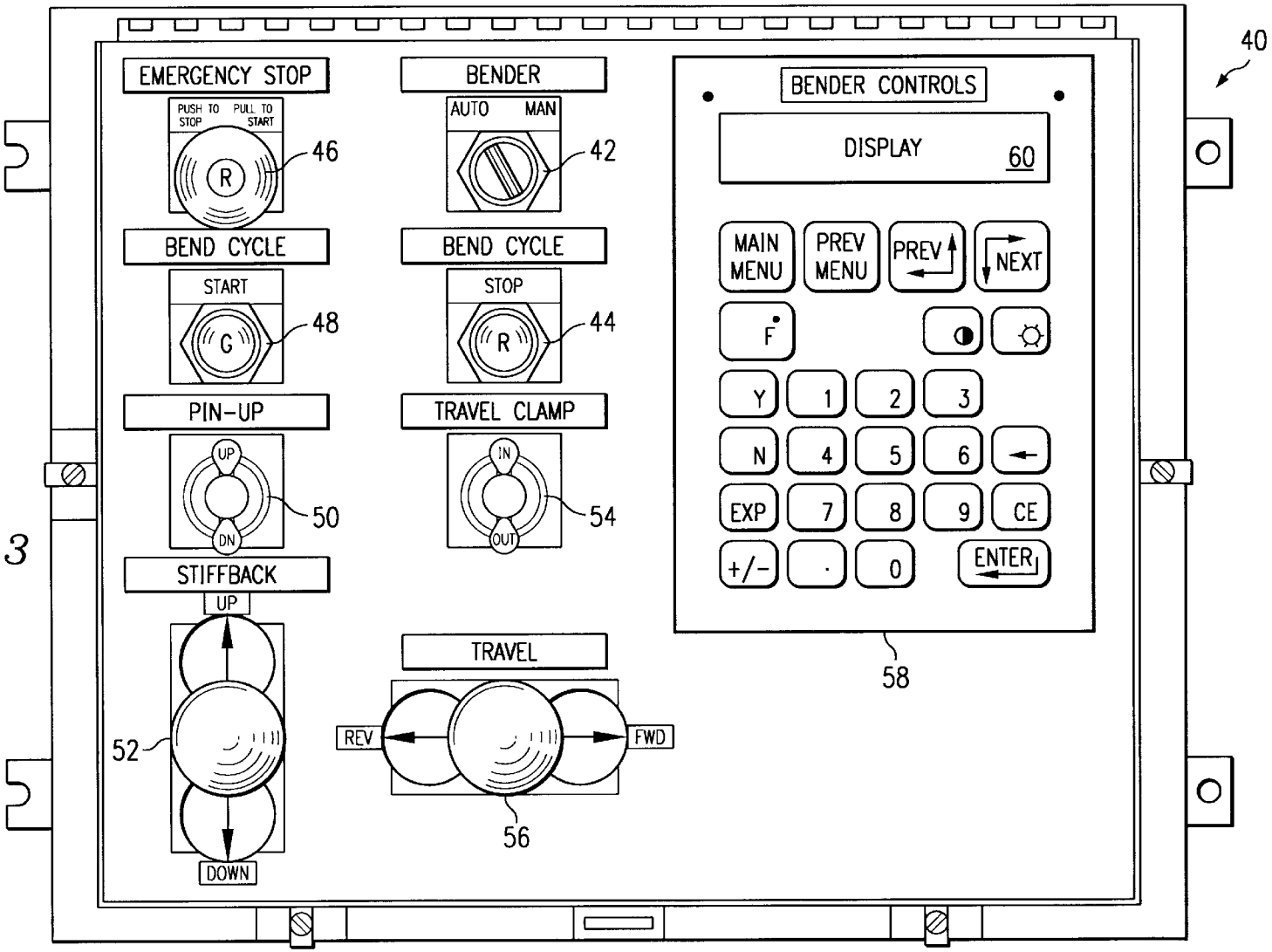
FIG. 3 is a frontal view of a control console utilized as an operator interface to a programmed processor.

In accordance with an important feature of the invention, the pipe bender 10 is automated in a manner to reduce the need for human judgments in the operation of the pipe bender 10. It should be understood that many other and different types and forms of pipe benders are known in the field and can be retrofit with the automated equipment of the invention. FIGS. 3 and 4 illustrate the primary components of the apparatus utilized in the preferred embodiment of the invention. With regard to FIG. 3, there is shown a control panel 40 for use by an operator of the pipe bender 10 to initiate and otherwise control the automatic bending operation according to the invention. The control panel 40 has a number of controls for operating the pipe bender 10 in either a manual mode, or an automatic mode under control of a processor. A switch 42 can be activated to place the control system in either a manual or automatic mode. A switch 44 can be activated to halt the pipe bender 10 while in a bend cycle. An emergency push-pull stop button 46 can be operated to remove power from the entire system and thereby to stop operation of any of the pipe bending equipment. An automatic bend cycle can be started by the activation of a "bend cycle" switch 48. When operated, a green light in the switch 48 is illuminated. The pin-up shoe 18 can be manually activated by a two-position switch 50. The pin-up shoe 18 can be moved to an up position to clamp the pipe in a fixed position, or to a down position to release the pin-up shoe 18 from the pipe 12. The stiffback 16 can be operated to either an up position or a down position by the activation of a stiffback joy stick switch 52. The pipe 12 can be axially moved by the use of pinch rollers 34 and powered rollers 30, as noted above. The pinch rollers 34 can be made to clamp to the pipe 12, or released therefrom by the activation of a switch 54. A travel joy stick switch 56 activates the hydraulic motors that turn the powered rollers 30 to thereby move the pipe in one direction, or the opposite, for proper axial placement in the pipe bending system 10. The joy stick switches 52 and 56 are of the type having a handgrip, and the extent of movement of the handgrip controls the speed or velocity of the object controlled.

A keypad 58 includes a number of touch keys for entering data in the programmed processor. A display 60 provides the operator of the control system with various instructions, prompts, or data displaying various operational parameters of the pipe bending system 10. The control panel 40 is electrically coupled via an interface to a processor 72, shown in FIG. 4.

FIG. 4 diagrammatically illustrates the various components of the pipe bending system 70 constructed according to the preferred embodiment of the invention. The pin-up shoe 18 is hydraulically operated by a double action hydraulic cylinder 74. The input and output hydraulic hoses are not shown. A solenoid valve 76 is associated with the pin-up hydraulic cylinder 74 for controlling the pressurized hydraulic fluid applied to the cylinder 74. The solenoid valve is of the type which can control hydraulic fluid so as to be applied to the cylinder 74, released from the cylinder 74, and to be placed in an off position. When the solenoid valve 76 is electrically operated via a digital output interface 77, the source of pressurized hydraulic fluid (not shown) is applied to the pin-up cylinder 74. The magnitude of the hydraulic pressure experienced by the pin-up cylinder 74 is measured by a pressure transducer 78. An electrical output of the pressure transducer, which corresponds to the magnitude of the hydraulic pressure, is coupled to the processor 72 by way of an analog input interface 80. When the solenoid valve 76 is controlled so as to be opened in one position, hydraulic pressure is applied to the pin-up cylinder 74, thereby clamping the pinup shoe 18 to the pipe 12. When a predefined hydraulic pressure is achieved, such as measured by the transducer 78, a signal is coupled to the processor 72. At the predetermined pressure, the solenoid valve 76 is placed in the off position by the processor 72, thereby maintaining the pin-up shoe 18 clamped to the pipe 12. By automatically monitoring the force by which the pin-up shoe 18 clamps to the pipe 12, undue deformation or damage to the pipe 12 is prevented. When the solenoid valve 76 is placed in the other position, hydraulic fluid is released from the cylinder 74, allowing the pin-up shoe 18 to be released from engagement with the pipe 12.

The structure of the pin-up shoe 18 is of conventional design such that it can clamp to the pipe 12 irrespective of the initial orientation of the pipe. In practice, the pin-up shoe 18 will initially clamp to the end of the pipe, which at that time is level or horizontal over its entire length. After the first incremental bend, both ends of the pipe 12 can no longer be at a level or horizontal position. Rather, in the operation of the pipe bender 10 to which the invention is retrofit, the stiffback end of the pipe 12 is always maintained at a level position, while the pin-up end of the pipe 12 is allowed to become elevated above the level position. After each incremental bend, the pin-up end of the pipe 12 raises higher to enable the stiffback end to maintain its level orientation. Hence, the pin-up shoe 18 is structured to grasp the respective end of the pipe at whatever elevation it may assume, and accurately and firmly maintain such elevation during the incremental bending operation.

The bending die 14 is situated between the pin-up shoe 18 and the stiffback 16. The stiffback 16 is controlled by a double-action hydraulic cylinder 82. Again, the hydraulic hoses associated with the stiffback cylinder 82 are not shown. Nonetheless, the pressurized hydraulic fluid coupled to the stiffback cylinder 82 is controlled by a proportional valve 84. As is well known, the extent by which the proportional valve 84 is opened, or closed, determines the volume of pressurized fluid coupled therethrough. With this arrangement, the speed or rate of movement of the hydraulic plunger of the cylinder 82 can be controlled. As will be described in more detail below, the rate of movement of the stiffback 16 is controlled according to a standard profile so as to maximize the efficiency of the bending operation, in terms of time required to move the stiffback 16, as well as to reduce wear and stress on the equipment due to abrupt starting and stopping movements. The proportional valve 84 is electrically controlled via an analog output interface 86. The extent of movement of the stiffback 16 is monitored and otherwise measured by a position transducer 88. In the preferred form of the invention, the position transducer 88 constitutes a cable-extension position transducer identified as model P8510, obtainable by Celesco, Canoga Park, Calif. The body of the position transducer 88 is fixed, but a cable 90 is connected to the stiffback 16. Accordingly, when the stiffback 16 is caused to move either upwardly or downwardly, the cable 90 is either extended or recoiled back in the position transducer 88. The extension or retraction of the cable 90 is measured by the transducer 88, and is directly proportional to the pivotal position of the stifiback 16. The output of the position transducer 88 is an analog signal coupled on the line 92 to the analog input interface 80. As can be appreciated, the position of the stiffback 16 is directly proportional to the extent of a bend formed in the pipe 12. In like manner, the position of the stiffback 16, and thus the pipe angle, is measured by the position transducer 88. The signal from the position transducer 88 is coupled to the processor 72 via the analog input interface 80. The processor 72 can correlate the data input by the cable position transducer 88 with the angle information supplied by the inclinometers 102 and 104. In other words, the processor 72 can determine the length of the cable 90 played out as a result of the raising of the stiffback 16 in order to achieve the desired resulting bend angle. Thereafter, the processor 72 need only raise the stiffback 16 the same amount in order to be assured that the same angle of bend will result. The cable position transducer 88 is highly accurate, i.e., 0.15 to 0.18 percent for a full stroke. If known in advance by the operator, this data can be entered via the keyboard 58 and stored in the computer without carrying out an initial bend in the pipe 12. Alternatively, the parameters can be loaded into the processor memory by a utility routine reading the data from a floppy disk or data received via a data link.

As noted above, the linear movement of the pipe 12 is controlled by powered drive rollers 30 and 32 (FIG. 2). An encoder 94 is coupled directly to a drive roller motor 36 (or other contact roller) for sensing the angular movement thereof The angular rotation of the shaft of the motor 36 is directly proportional to the angular movements of the roller 30. The encoder 94 is of standard design for converting angular motions of the motor to corresponding digital pulses. For example, for an angular movement of one degree, the encoder 94 would output 100 digital pulses. For angular movements less than one degree, a corresponding fewer number of pulses would be output. The output of the encoder 94 couples the digital pulses on a digital line 96 to the digital input interface 98. The processor 72 is programmed to count the number of digital pulses from the encoder 94 and translate such number with a linear distance that the pipe 12 would have been moved in an axial direction. A proportional valve 100 is operative to hydraulically control the speed and direction of the motor 36 which powers the roller 30. The proportional valve 100 is controlled by the analog output interface 86.

Information concerning the angular orientation of the pipe 12 is necessary in order to determine the exact angle formed as a result of each incremental bend, as well as the overall angular bend when the bending operation is completed. A pair of inclinometers is utilized at each end of the pipe 12 to determine the angular orientation thereof A first inclinometer 102 is attached to the end of the pipe 12 that is held in a fixed orientation by the pin-up shoe 18. A second inclinometer 104 is fixed to the end of the pipe supported by the stiffback 16. In the preferred form of the invention, the inclinometers 102 and 104 are attached to the respective ends of the pipe 12 by permanent magnets. Each inclinometer 102 and 104 transmits angle information to a receiver 106. The inclinometer system can be of the type disclosed in U.S. Pat. No. 4,649,726 by Trammell et al., the disclosure of which is incorporated herein by reference. The angle formed between the ends of the pipe 12, if any, is visually displayed on a display built in the receiver 106

It is contemplated that the inclinometer receiver 106 will be utilized to provide angle information to the processor 72 via a line to the analog input interface 80. The line is shown as a broken line in FIG. 4. The processor 72 can be programmed to calculate the difference in the readings of the inclinometers to determine the instantaneous angle by which the pipe 12 has been bent or otherwise deformed. Nevertheless, without a communication link between the inclinometer receiver 106 and the processor 72, the operator visually ascertains the extent of the bend and the receiver 106 during the initial incremental band. Described below is the technique by which the actual bend angle is correlated with the cable extension of the cable position transducer 88.

As can be seen from FIG. 4, the processor 72 is coupled to the various digital and analog interfaces, and therethrough to the operator console 40. Of course, a power supply 110 is utilized to power the electrical equipment required to operate and control the pipe bending system 70.

The processor 72 is of a general purpose type, such as a programmable logic controller, SLC500 series, obtainable from Allen-Bradley. The processor 72 is programmed to carry out the operations illustrated in the flow chart of FIGS. 5 and 6.

In some instances, the operator of the pipe bending system 70 must undergo a first incremental bend in order to determine various parameters of the pipe. For example, if it is not known in advance, the operator must determine the extent of springback of the particular type of pipe. The springback of the pipe is that amount of angular bend beyond which the pipe must be bent so that when the pipe is then relaxed, a bend of the desired angle remains in the pipe. For example, if it is desired to incrementally bend a pipe ¼°, and the pipe has an inherent springback characteristic of ¼°, then the pipe may be required to be bent at an angle of ½°, so that when the pipe is released it returns ¼° to the rest state. Hence, a ¼° bend will remain in the pipe after the bending operation.

In order to initially load the pipe 12 into the pipe bending machine 70, as well as to determine the extent of springback and any other parameters, the operator sets the control console to the manual mode, as determined by the position of switch 42. In the manual mode, the pipe 12 is inserted horizontally through the pin-up shoe 18 until the front end of the pipe rests fully on the stiffback 16. The internal mandrel 20 is then driven into the pipe until it is registered with respect to the bending die 14. The mandrel 20 can be moved and positioned in the manner described in U.S. Pat. No. 5,651,638 by Heggerud, the disclosure of which is incorporated herein by reference. The angle inclinometers 102 and 104 are then attached to the top surfaces of the pipe 12. The pinch rollers 34 are then operated to engage the pipe 12 by activation of the switch 54. The operator of the system 70 then operates the stiffback joy stick switch 56 to raise the stiffback 16 until the pipe 12 is level and until it just touches the lowest point of the undersurface of the bending die 14. When in this position, the operator keys the level indication into the keypad 58, whereupon the processor 72 causes the display of "zero pipe". In addition, the processor 72 stores the level position in its memory as a reference to all subsequent bends made. Indeed, even if the pipe 12 itself is not exactly level with respect to gravity, all subsequent bends are made with regard to this non zero reference so that accurate bends in the pipe 12 will be made. Importantly, once the stiffback 16 is "leveled", it remains in such orientation and all subsequent bends are made utilizing the initial stiffback orientation.

Next, the operator raises the pin-up shoe 18 for engagement with the pipe 12. This operation is commenced when the operator moves the pin-up switch 50 to the "up" position, whereby the pin-up hydraulic cylinder 74 operates to extend its plunger for clamping the pin-up shoe 18 around the pipe 12. This constitutes the initial position of the pin-up shoe 18 for starting each incremental bend of the pipe 12. The segmented die operates simultaneously with the pin-up shoe 18, so that the segmented die engages with the bottom of the pipe 12, under the bending die 14. As noted above, after the initial incremental bend, the position of the pin-up shoe 18 will be correspondingly higher with each subsequent bend, up to a maximum point, where the pipe has been bent to the angle required. Stated another way, if five ¼" bends are to be made, the pin-up shoe 18 will be raised a ¼ degree on the 2nd through 5th bends. In this manner, at the start of each incremental bend, the end of the pipe 12 in the stiffback 16 will be level. The maximum extent by which a pipe will be bent constitutes a "bend maximum set point", which relates to the maximum raised position of the stiffback 16 in forming an angle in the pipe, including any springback of the pipe 12. This may also be the maximum position that the stiffback cylinder 82 will travel. The operator can also enter the bend maximum set point via the keyboard 58. Any attempt to bend the pipe 12 beyond the bend maximum set point may result in damage to the pipe.

As noted above, the mandrel 20 is inserted into the pipe 12, and is registered with respect to the bending die 14. After each incremental bend, the mandrel 20 is retracted radially inwardly so that the pipe 12 can be axially moved by the powered rollers 30. Then, the mandrel 20 is reregistered, reexpanded and set in the pipe 12 for the subsequent incremental bend.

The pipe 12 undergoes an initial bend by the operator moving the stiffback lever 52 to the up position. The operator holds the switch 52 in such position until the stiffback cylinder 82 moves the stiffback 16 upwardly until the pipe "fills" the concave undersurface of the bending die 14, i.e., until the pipe 12 is in contact with the die surface from the center of the die 14 to the frontal edge thereof, and until the inclinometer receiver display indicates the defined bend angle, including any springback. Again, the pipe 12 is forced by the stiffback 16 to an angle such that when the pipe springs back to a rest position, the desired angle remains in the pipe 12.

Importantly, when the maximum upward position of the stiffback 16 is reached to achieve the desired bend angle, the operator keys in on the keypad 58 an indication to the processor 72 that the feedback data of the cable position transducer 88 should be stored. This feedback data produced by the cable position transducer 88 is directly related to the pivotal position of the stifiback 16 that produces the desired bend angle. Thereafter, when the stiffback 16 is pivoted to a position that causes the transducer 88 to output the identical feedback signal, then it is known that the very same bend angle will be achieved. In view that highly accurate sensors and transducers are utilized, highly accurate and repeatable bends can be achieved.

Once the initial bend is completed, the operator lowers the pin-up shoe 18 by utilizing the down position of the pin-up switch 50. Next, the operator lowers the stiffback 16 by operating the switch 52 to the down position. The mandrel 20 is then retracted within the pipe 12 so that such pipe can be axially moved.

Before moving the pipe 12 to the subsequent incremental bend position, the operator can check the actual angle formed in the pipe 12, using the angle inclinometers 102, 104 and the receiver 106. As noted above, the receiver 106 includes a visual display itself for displaying the angle formed within the pipe 12. In addition, the processor 72 can be programmed to translate the cable position transducer feedback data into bend angles and display the resulting bend angles with the display 60 of the operator control console 40. A correlation table in software would be effective to accomplish this. If the pipe 12 is not bent at the proper bend angle, the operator can again bend the pipe 12 manually by engaging the pin-up shoe 18 and raising the stiffback 16 further to increase the angle of bend. In order to carry out subsequent incremental bends automatically, the operator enters the appropriate bend angle, which includes the springback of the pipe 12, by selecting the menu "enter degrees" using the keypad push buttons. Then, the operator can enter the actual degrees per incremental bend, using the "enter" key of the keypad 58. In a similar manner, the operator can enter the number of bends to be carried out and the linear distance between each incremental bend.

Once the actual bend angle is entered in the processor 72 by the operator and stored in the memory, the operator advances the pipe 12 axially a prescribed distance. If the distance between incremental bends is to be, for example, four inches, then the operator finds the appropriate menu, enters the incremental distance between bends via the keypad 58. As noted above, the angle by which the stiffback 16 moves, which corresponds to the bending angle, is sensed by the linear cable position transducer 88, which provides corresponding signals to the processor 72 so that the stiffback can be moved to a position to achieve the desired bend angle. The mandrel 20 is then again repositioned and expanded for the next incremental bend operation. The foregoing constitutes the initial considerations in obtaining information and parameters of the particular pipe being bent, so that all subsequent bends will be carried out in a corresponding manner. As noted above, to accomplish, for example, a 5° overall pipe bend, a number of incremental bends may be carried out at different locations in the pipe. By making each incremental bend uniform, due to the automated nature of the invention, highly accurate overall bends can be accomplished. This not only reduces the number of pipes that may be damaged, over bent or otherwise rendered unusable, the automated nature of the pipe bending system 70 allows the operations to be carried out more quickly and in a more highly accurate manner.

After having established the pipe bending parameters in the first incremental bend, all subsequent bends in the pipe 12 can be accomplished automatically under control of the processor 72 carrying out instructions that accomplish the functions shown in the flow charts of FIGS. 5 and 6.

It should be understood that the foregoing steps can be omitted in a large part, if the corresponding data and parameters are already known. In other words, if such initial data and parameters are known to the operator, the information can be entered directly into the computer via the keypad 58 and utilized to automatically carry out the first incremental bend as well as the remaining incremental bends.

The flow chart 120 of FIGS. 5 and 6 depict the automatic operation of the pipe bending system 70, as controlled by the programmed processor 72. The automatic bend cycle is commenced by the depression of switch 48 by the operator. This is noted in program flow chart 122. In response, the processor 72 provides an output signal for illuminating the green "auto cycle" light, as noted in program flow block 124. Processing proceeds to program flow block 126 where the stiffback 16 is automatically moved to the level position, as determined by the initial incremental bend. The stifiback 16 is moved to the level position by the automatic operation of the front stiffback hydraulic cylinder. The feedback from the cable position transducer 88 provides information to the processor 72 so that movement of the stiffback 16 can be stopped at the preprogrammed level position. Program flow block 128 illustrates the output command by the processor 72 for operating valving apparatus to move the front stifiback cylinder 82 to the level position. The level position is displayed by the processor 72 on display 60, as noted in program flow block 130. A "zero" display reading indicates a stiffback level position. In the preferred form of the invention, a delay 132 is interposed after the stiffback leveling operation to thereby assure the completion of the operation of one routine, before proceeding to the next software routine.

In program flow block 134, the processor 72 operates the solenoid valve 76 to allow the pin-up shoe 18 to move to a position in which the pipe 12 is firmly clamped. The pressure applied by the pin-up shoe 18 to the pipe 12 is monitored by the pressure transducer 78 to assure a positive, but non-damaging grip with the pipe 12. As noted above, the processor 72 was programmed to store a predetermined pressure which, when reached and sensed by the transducer 78, causes the solenoid valve 76 to shut off and thereby maintain the clamping pressure on the pipe 12. Program flow block 136 illustrates the electrical command output by the processor 72 for accomplishing the predetermined clamping pressure to the pipe 12 by the pin-up shoe 18. In response to this command, the segmented die under the pipe 12 moves upwardly to hold the pipe against the bending die 14. Program flow block 138 illustrates the feedback from the pressure transducer 78 to the processor 72 via the analog input interface 80 so as to monitor the hydraulic pressure during the pin-up clamping operation. In program flow block 140 the processor 72 reads from memory the data corresponding to the predetermined pin-up clamping pressure. This allows the processor 72 to compare the actual pin-up pressure with the stored data and stop the clamping operation when the actual pin-up pressure matches that read by the processor 72 in program flow block 140. The pin-up pressure is displayed on the visual display 60, as noted in program flow block 142. Again, a programmed delay 144 is interposed after the operation in moving the pin-up shoe 18 in a clamping arrangement with the pipe 12.

Program flow block 146 includes those instructions for causing the stiffback 16 to move to the predetermined bend set point to accomplish the desired incremental angle in the pipe 12. As noted above, the initial bend set point was obtained from the cable position transducer 88. The bend set point is read from the processor memory according to program flow block 148. The processor 72 outputs a command according to program flow block 150 to operate the stiffback hydraulic cylinder 82 and lift the stiffback 16 to commence the incremental bending operation. In program flow block 152 the processor 72 inputs readings from the cable position transducer 88 to thereby determine the exact instantaneous position of the stiffback 16. As noted above, the bend set point stored in memory constitutes the angle of desired bend in addition to any springback angle. Nonetheless, the processor 72 controls the stiffback cylinder 82 to cause movement of the pipe 12 until the bend set point is reached, as determined by the feedback produced by the cable position transducer 88. The upward movement of the stiffback 16 is programmed by the processor 72 to move upwardly in a linearly increasing manner to a maximum velocity, and then slow down toward an end point where the velocity of movement of the stifiback 16 is zero. This triangular movement profile is well known in the art, and is accomplished by the control of the proportional valve 84. Other profile shapes, like a trapezoid, and others, can be utilized by those skilled in the art. A programmed delay 154 is established after the stiffback moving routine.

In program flow block 156 the stiffback 16 is lowered to its full down position. This function is accomplished by the processor 72 outputting a stiffback lower command, as shown in program flow block 158. Much like the movement of the stiffback according to program flow block 146, the downward movement occasioned by the instructions of program flow block 156 are carried out according to a triangular-shaped velocity profile. A programmed delay 160 is interposed after the stifiback lowering routine 156.

With reference now to FIG. 6, once the stiffback 16 is moved to its lowered position, the pin-up clamp 18 is moved to its full back set point position, as shown in program flow block 170 of FIG. 6. Program flow block 172 shows the actual outputting by the processor 72 of the command to the pin-up clamp apparatus for operating the hydraulic equipment to move the pin-up clamp 18 to its full back position. A delay 174 is interposed after the operations of program flow block 170.

In program flow block 176, the bend cycle terminates, whereupon the processor 72 outputs a command to extinguish the green auto cycle lamp. This is shown in program flow block 178.

The instructions of program flow block 180, when carried out by the processor 72, allow the pipe 12 to be incremented a predetermined axial distance, once the travel switch 56 is manually bumped. The travel switch 56 need not be held down by the operator, but only bumped so as to signal the processor 78 to move the pipe 12 a distance that corresponds to the length of pipe between incremental bends. This parameter was programmed initially in the memory of the processor 72. It should be noted that the operation of program flow block 180 can be carried out without operator invention of bumping the switch 56, but rather can be automatically carried out after the end bend cycle routine 176.

With reference yet to FIG. 6, there is shown in program flow block 182 the instructions for actually moving the pipe 12 forwardly for the next bend. In order to determine the exact distance by which the pipe 12 is to be moved, the processor 72 reads the memory and inputs the travel increment, as noted in program flow block 183. The processor 72 outputs the command to the travel proportional valve 100, as noted in program flow block 185, As noted above, this allows the powered roller motor 36 to be operated to rotate the roller 30 and correspondingly move the pipe 12 a specified distance. The angular rate of movement of the motor 36 can also follow a velocity profile path to quickly accomplish movement of the pipe without abrupt starting and stopping operations. Any undershoot or overshoot is eliminated. Once the pipe 12 commences axial movement, the processor 72 counts the number of pulses from the encoder 94 to measure the exact distance the pipe 12 is being moved. This is shown in program flow block 188. Once the pipe 12 has been moved its prescribed incremental distance, it is stopped. Processing continues to decision block 184, where it is determined whether all of the incremental bends in the pipe 12 have been completed. If the decision of block 184 results in the affirmative, then the auto incremental bend cycle is completed, as noted by program flow block 186. If, on the other hand, further incremental bends are to be completed, processing proceeds to program flow block 188. Here, processing branches back to program flow block 122 of FIG. 5, where another automated bending cycle can be commenced by the actuation of the start switch by the operator. Those skilled in the art may prefer to continue with subsequent incremental bends without operator intervention. In this case, the processing would branch back to program flow block 126 and bypass block 122. Of course, the auto cycle lamp would not be extinguished in the fully automatic mode.

While not shown, the processor 72 is programmed to continually monitor the actuation of the control panel switches. For example, if during a bending operation the emergency stop switch 46 or the bend cycle stop switch 44 are operated, the processor 72 will halt operation. If actuation of the emergency stop switch 46 is sensed, the power supply 110 is shut off to the pipe bending system. If the bend cycle stop switch 44 is pushed, the bending cycle is interrupted, but will commence when the bend cycle start switch 48 is subsequently pushed. Those skilled in the art may find it useful to program the processor 72 with other algorithms to carry out diagnostics on the system and even to initially calibrate the system. As noted above, the processor can be programmed to input angle information directly from the inclinometers. This information is instantaneous data that is directly representative of the bend angle that the pipe is then undergoing. This angle information itself can be utilized to determine when the pivotal movement of the stiffback should be stopped when the desired bend angle is achieved. To that end, it may be possible to dispense with the cable position transducer and rely solely on the inclinometers.

From the foregoing, disclosed is an automated pipe bending system where much, if not all, of the operations are carried out automatically under control of a programmed processor. By utilizing processor controlled apparatus, as well as sensors for sensing various aspects of the operation for purposes of feeding back information and data to the processor, highly accurate bends in the pipe can be made in a repeated manner. While the preferred embodiment of the method and apparatus have been disclosed with reference to a specific pipe bending system, it is to be understood that many changes in detail may be made as a matter of engineering and software choices without departing from the scope of the invention as defined by the appended claims.

Indeed, those skilled in the art may prefer to embody the apparatus in other forms, and in light of the present description it will be found that such choice can be easily implemented. Also, it is not necessary to adopt all of the various advantages and features of the present disclosure into a single composite pipe bending system in order to realize the individual advantages. Accordingly, such features are individually defined in the appended claims.

What is claimed is:

1. Pipe bending apparatus, comprising:

a pin-up clamp for clamping to a pipe;

a bending die, a stiffback for supporting the pipe, said stiffback being movable with respect to said pin-up clamp for moving a portion of said pipe and forming a bend therein;

a sensor for sensing relative positions of said pipe and providing output indications of an angular orientation of the pipe; and a processor programmed to control movement of said stiffback, said processor storing data corresponding to a desired bend angle, and said processor receiving said indications of angular orientations of said pipe and for comparing the stored bend angle with said indications of angular orientation, and programmed to cause said stiffback to stop moving when there is equality between said stored bend angle and said indication of angular orientation.

2. The pipe bending apparatus of claim 1, wherein said stored bend angle comprises an angle desired to remain in said pipe plus a springback angle.

3. The pipe bending apparatus of claim 1, wherein said processor is programmed to move said stiffback from a start to a stop according to a predefined velocity profile.

4. The pipe bending apparatus of claim 3, further including a hydraulic cylinder for moving said stiffback, and a proportional valve associated with said hydraulic cylinder for moving a plunger of said hydraulic cylinder under control of said processor.

5. The pipe bending apparatus of claim 1, further including a hydraulic cylinder associated with said pin-up clamp, and including a pressure sensor for sensing a pressure associated with a force applied by said pin-up clamp to the pipe, and wherein said processor is programmed to store a predefined pressure parameter and for comparing said predefined pressure parameter with said sensed pressure to control said pin-up clamp hydraulic cylinder.

6. The pipe bending apparatus of claim 1, further including a pipe transfer apparatus for axially moving the pipe in said pipe bending apparatus, said pipe transfer apparatus including a sensor for sensing axial movement of the pipe, and said processor being programmed to control said pipe transfer apparatus in response to said sensor that senses axial movement of the pipe.

7. The pipe bending apparatus of claim 6, wherein said axial movement sensor comprises an encoder that produces digital signals in response to a distance by which the pipe is axially moved.

8. The pipe bending apparatus of claim 1, wherein said processor is programmed to carry out a plurality of incremental bends in the pipe.

9. The pipe bending apparatus of claim 1, wherein said sensor comprises an inclinometer.

10. The pipe bending apparatus of claim 6, wherein said processor is programmed to store data corresponding to a predefined distance by which said pipe is to be axially moved.

11. The pipe bending apparatus of claim 1, wherein said processor is programmed to store data corresponding to a number of bends to be formed in said pipe.

12. The pipe bending apparatus of claim 11, wherein said processor is programmed to carry out a number of pipe bending cycles corresponding to said stored number of bends.

13. Pipe bending apparatus, comprising:

a pin-up clamp, and a hydraulic cylinder for moving said pin-up clamp;

a stiffback, and a hydraulic cylinder for moving said stiffback;

a processor programmed to store a predefined pressure experienced by said pin-up clamp hydraulic cylinder, to store a parameter defining a bend angle, to store a parameter defining a number of bends to form in the pipe, and to store a parameter defining a distance between each said bend, and a plurality of sensors for sensing the operation of the pipe bending apparatus and for providing feedback data from said sensors to said processor.

14. The pipe bending apparatus of claim 13, wherein said processor is programmed to operate said hydraulic cylinders in response to ones of said feedback data.

15. The pipe bending apparatus of claim 13, further including a motorized pipe transfer mechanism for axially moving the pipe, and wherein said processor is programmed to operate said motorized pipe transfer mechanism according to said parameter defining a distance between each said bend.

16. The pipe bending apparatus of claim 13, wherein said processor is programmed to carry out a plurality of incremental bends in the pipe to form a bend with an overall desired bend.

17. A method of bending a pipe, comprising the steps of:

clamping a portion of the pipe in a fixed position;

moving another portion of the pipe to a predefined position under control of a programmed processor;

generating a feedback signal corresponding to a position of the pipe during bending thereof, and using said feedback signal by the programmed processor and comparing the feedback signal with a reference to control movement of the pipe during bending thereof.

18. The method of claim 17, further including controlling axial movement between pipe bends by said programmed processor.

19. The method of claim 17, further including storing in a memory used by said programmed processor a bend set angle defining said reference, said bend set angle including an angle which is to remain in said pipe after bending thereof, and including a springback angle.

20. The method of claim 17, further including clamping said pipe to said fixed position under control of the programmed processor.

* * * * *